US010986948B2

(12) United States Patent
Radcliffe et al.

(10) Patent No.: US 10,986,948 B2
(45) Date of Patent: Apr. 27, 2021

(54) COLLAPSIBLE SERVING TRAY COVERING SYSTEM

(71) Applicants: Daniel Radcliffe, Indianapolis, IN (US); Seth Hopp, Indianapolis, IN (US)

(72) Inventors: Daniel Radcliffe, Indianapolis, IN (US); Seth Hopp, Indianapolis, IN (US)

( * ) Notice: Subject to any disclaimer, the term of this patent is extended or adjusted under 35 U.S.C. 154(b) by 38 days.

(21) Appl. No.: 16/204,659

(22) Filed: Nov. 29, 2018

(65) Prior Publication Data

US 2019/0090673 A1 Mar. 28, 2019

Related U.S. Application Data

(60) Provisional application No. 62/711,235, filed on Jul. 27, 2018.

(51) Int. Cl.
*A47G 23/06* (2006.01)
*A47G 19/26* (2006.01)

(52) U.S. Cl.
CPC ..... *A47G 23/0633* (2013.01); *A47G 19/26* (2013.01)

(58) Field of Classification Search
CPC .... A47G 23/0633; A47G 19/26; A47G 23/06; B65F 1/16
USPC ..... 220/212.5
See application file for complete search history.

(56) References Cited

U.S. PATENT DOCUMENTS 2,080,786 A * 5/1937 Robles ..... B65D 43/00 220/252
2,250,729 A * 7/1941 Smith ..... B65D 43/00 220/252
3,156,213 A * 11/1964 Patten ..... B65D 85/50 119/497
3,868,155 A * 2/1975 Cherubini ..... A47G 5/00 135/132
7,007,813 B2 3/2006 Yang
7,575,125 B2 * 8/2009 Bagley, Jr. ..... A47G 23/06 220/475
7,712,437 B2 * 5/2010 Leung ..... A01K 1/0245 119/28.5
8,176,855 B1 5/2012 Cannon et al.
8,974,359 B2 3/2015 Calzada et al.
2006/0045943 A1 3/2006 Calzada et al.
2008/0000398 A1 * 1/2008 Barkley ..... A47G 19/26 108/90
2011/0084071 A1 * 4/2011 Gundersen ..... A47G 19/26 220/252

(Continued)

*Primary Examiner* — Shawn M Braden

(74) *Attorney, Agent, or Firm* — Boudwin Intellectual Property; Daniel Boudwin

(57) ABSTRACT

A food serving tray cover system that is removably attachable to various food serving trays to form an enclosure wherein the contents of the enclosure will be protected from pests such as birds and insects. The collapsible food serving tray cover system includes an elongated bracket having a U-shape and defining a channel therein that can removably secure a serving tray. A covering assembly including canvas-like material is attached at regular intervals to support ribs which are pivotally connected on the arms of the U-shaped bracket. The covering assembly is deployable such that the canvas material and support ribs move radially along the pivotal connection in a 180-degree manner to form an interior volume over an attached serving tray. A handle provides a gripping area that allows for selective closing and opening of the food serving tray cover system.

17 Claims, 4 Drawing Sheets

(56) References Cited

U.S. PATENT DOCUMENTS

| | | | | |
|---|---|---|---|---|
| 2011/0209645 | A1 | 9/2011 | Pinzon et al. | |
| 2017/0325638 | A1* | 11/2017 | Davis | A47J 45/10 |

* cited by examiner

COLLAPSIBLE SERVING TRAY COVERING SYSTEM

CROSS REFERENCE TO RELATED APPLICATIONS

This application claims the benefit of U.S. Provisional Application No. 62/711,235 filed on Jul. 27, 2018. The above identified patent application is herein incorporated by reference in its entirety to provide continuity of disclosure.

BACKGROUND OF THE INVENTION

The present invention relates to a collapsible serving tray covering system. More specifically, the present invention provides an attachment removably securable to a serving tray wherein a means of covering the contents of the dish is pivotally attached to an elongated bracket having a defined channel therein.

Many people enjoy outdoor events, gatherings, and barbeques where food is served and enjoyed. However, during the preparation and serving, the food is often placed on trays exposed to the outside environment. Food stored in this manner can be exposed to insects and other pests that can steal, contaminate, or otherwise spoil the food. Particularly at beach and shore locations, seagulls tend to aggressively attempt to steal and feed on the unprotected food as well as potential threats from sand contamination and high winds. In a more general case, flies and other insects remain a common problem for exposed foods no matter where you are located and continue to be a problem for outdoor social gatherings where food is being served. There exists a need for a device that can removably secure to a food serving tray having a canvas supported by a deployable frame member wherein the frame member comprised of a louvered arrangement.

Devices have been disclosed in the known art that relate to food trays including retractable covers. These include devices that have been patented and published in patent application publications. These devices generally relate to food trays with removable lids or individualized compartments. These devices include serving trays having at least one compartment with the function of keeping food fresh as well as multipurpose systems that allow a user to keep and serve food and drinks in a functional manner. These devices, however, fail to disclose a food tray including a canvas material attached to a retractable support having a plurality of louvers configured to selectively open and close the food tray to keep contents safe from insects and birds. Furthermore, unlike the known art, the present device includes transparent material to allow users to view the contents of the food tray while the device is in a closed position.

In light of the devices disclosed in the known art, it is submitted that the present invention substantially diverges in design elements from the known art and consequently it is clear that there is a need in the art for an improvement to existing collapsible serving tray coverings. In this regard, the invention substantially fulfils these needs.

SUMMARY OF THE INVENTION

In view of the foregoing disadvantages inherent in the known types of collapsible serving tray coverings now present in the known art, the present invention provides a removably attachable serving tray covering wherein the same can be utilized for providing convenience for the user when removably installed on a food serving tray.

It is therefore an object of the present invention to provide a new and improved collapsible serving tray covering system that has all of the advantages of the prior art and none of the disadvantages.

It is another object of the present invention to provide a collapsible serving tray covering system comprising an elongated bracket forming a U-shape wherein a channel defined within is configured to receive serving trays, and a covering assembly pivotally connected to the arms of the elongated bracket having a canvas material attached to a plurality of rib supports.

Another object of the present invention is to provide a collapsible serving tray covering system wherein the fabric material of the covering assembly is comprised of a lightweight canvas.

Yet another object of the present invention is to provide a collapsible serving tray covering system wherein a clear plastic window is incorporated within the fabric material of the covering assembly.

Another object of the present invention is to provide a collapsible serving tray covering system wherein the pivotally attached ribs of the covering assembly are of a flat, metallic construction and sewn within the fabric material at regular intervals.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
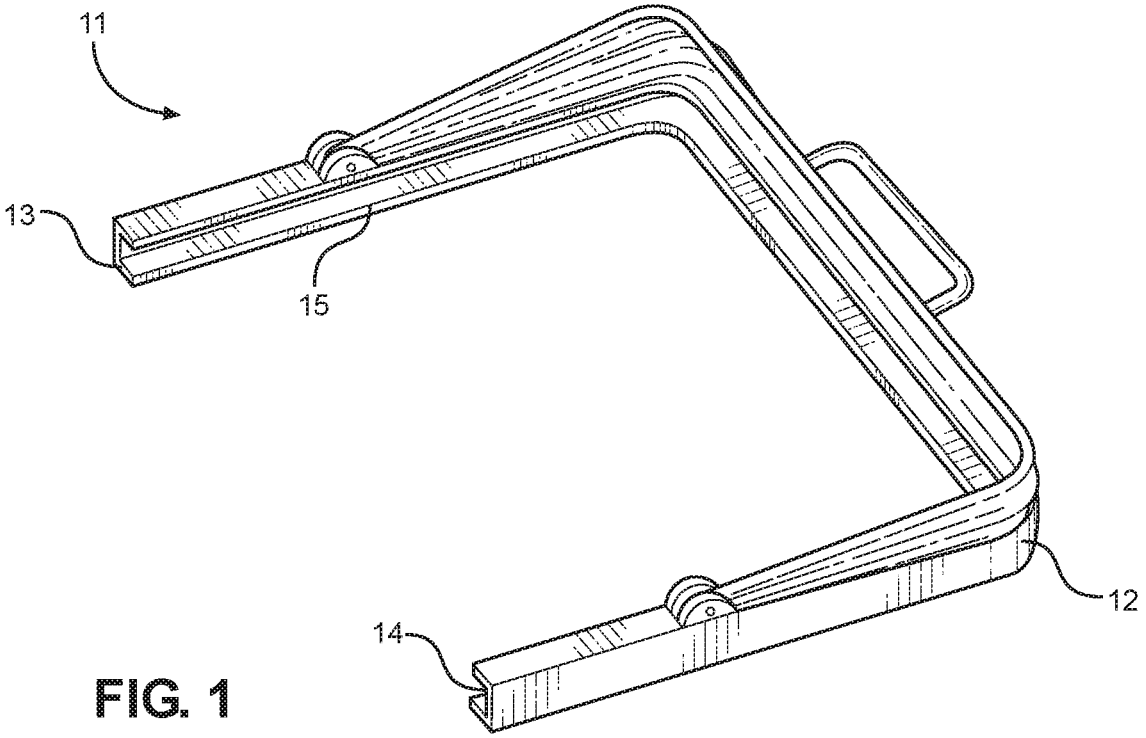
FIG. 1 shows a perspective view of an embodiment of collapsible serving tray covering system in an open position.

Reference is made herein to the attached drawings. Like reference numerals are used throughout the drawings to depict like or similar elements of the collapsible serving tray covering system. For the purposes of presenting a brief and clear description of the present invention the preferred embodiment will be discussed as used for removably securing to a standard serving tray. The figures are intended for representative purposes only and should not be considered to be limiting in any respect.

Figure 2:
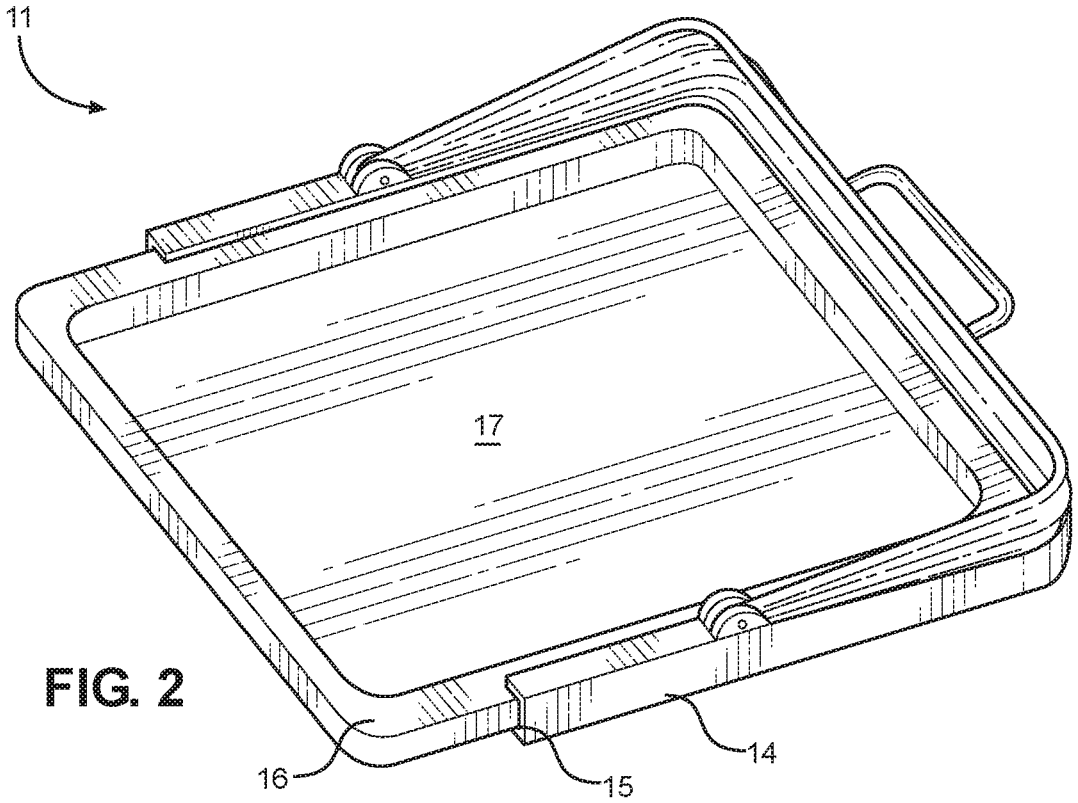
FIG. 2 shows a close-up perspective view of an embodiment of the collapsible serving tray covering system in an open position with serving tray removably attached.

Referring now to FIGS. 1 and 2, there is shown a perspective view of an embodiment of the collapsible serving tray covering system in an open position and a close-up perspective view of an embodiment of the collapsible serving tray covering system in an open position with a serving tray removably attached, respectively. The collapsible serving tray covering system 11 comprises an elongated bracket 12 having perpendicular protrusions 13 and 14 at both ends such that a U-shaped enclosure is defined. A channel 15 is disposed within an interior side of the elongated bracket 12 and running continuous across each of the perpendicular protrusions 13 and 14 oriented toward the center of the enclosure in a manner to create a bracket adapted to removably receive an outer rim 16 of a serving tray 17. The channel 15 within the elongated bracket 12 allows the serving tray 17 to slide in and out of the collapsible serving tray covering system 11 so that the outer rim 16 of the serving tray 17 is resting within the channel 15 and flush against the elongated bracket 12 and its perpendicular protrusions 13 and 14. The collapsible serving tray covering system 11 is composed of any suitable, durable, rigid material, such as metal. In the illustrated embodiment, the elongated bracket 12 is of a fixed length. In other embodiments, the size of the enclosure within the perpendicular protrusions 13 and 14 of the elongated bracket 12 can be adjusted to accept a smaller or larger size serving tray 17.

Figure 3:
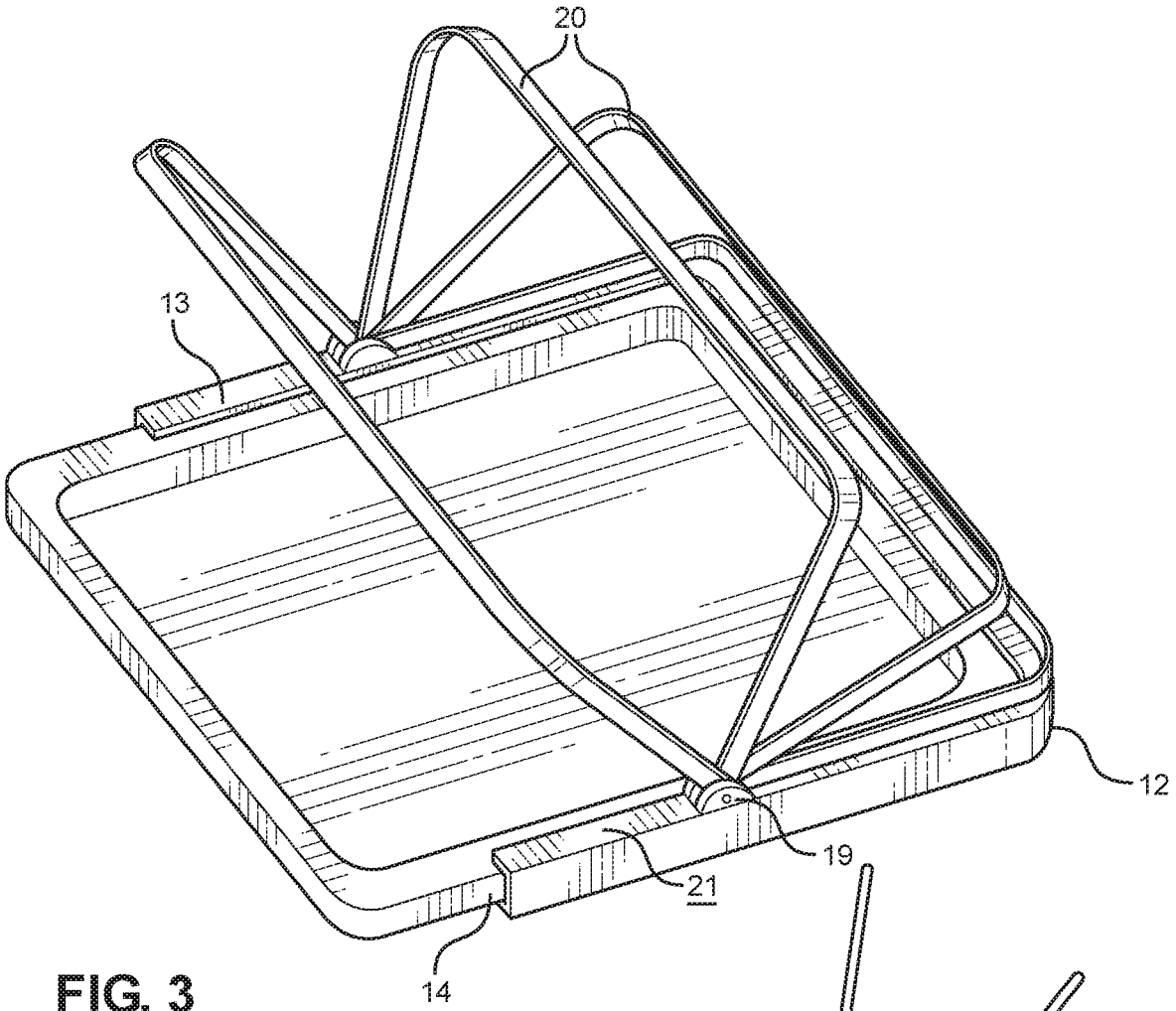
FIG. 3 shows a perspective view of an embodiment of the collapsible serving tray covering system with serving tray removably attached and support ribs showing.
Figure 4:
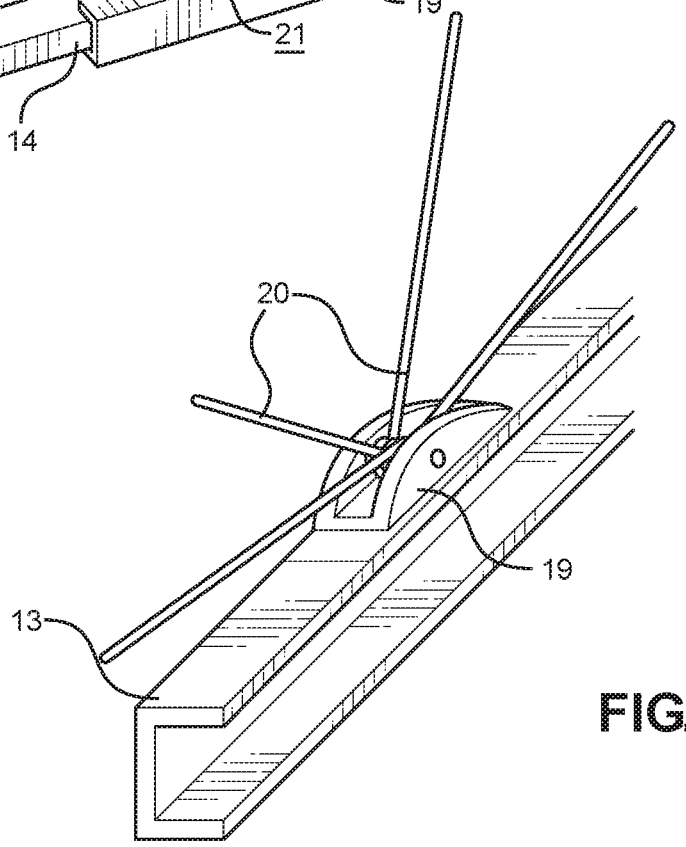
FIG. 4 shows a close-up perspective view of an embodiment of the collapsible serving tray covering system showing pivotal connection of support ribs.

Referring now to FIGS. 3 and 4, there is shown a perspective view of an embodiment of the collapsible serving tray covering system with serving tray removably attached and support ribs showing and a close-up perspective view of an embodiment of the collapsible serving tray covering system showing pivotal connection of support ribs, respectively. A plurality of rib supports 20 is comprised of elongated, U-shaped members which are pivotally affixed to connectors 19 on a top surface 21 of the perpendicular protrusions 13 and 14 of the elongated bracket 12. The pivotal connections about the connector 19 allow the rib supports 20 to move radially along the top surface 21 of the elongated bracket 12 in a 180-degree range. The rib supports 20 construction comprises louvers of a flat, rectangular cross section, however, in alternate embodiments, the cross section can be any suitable shape, including a circular cross section.

Figure 5:
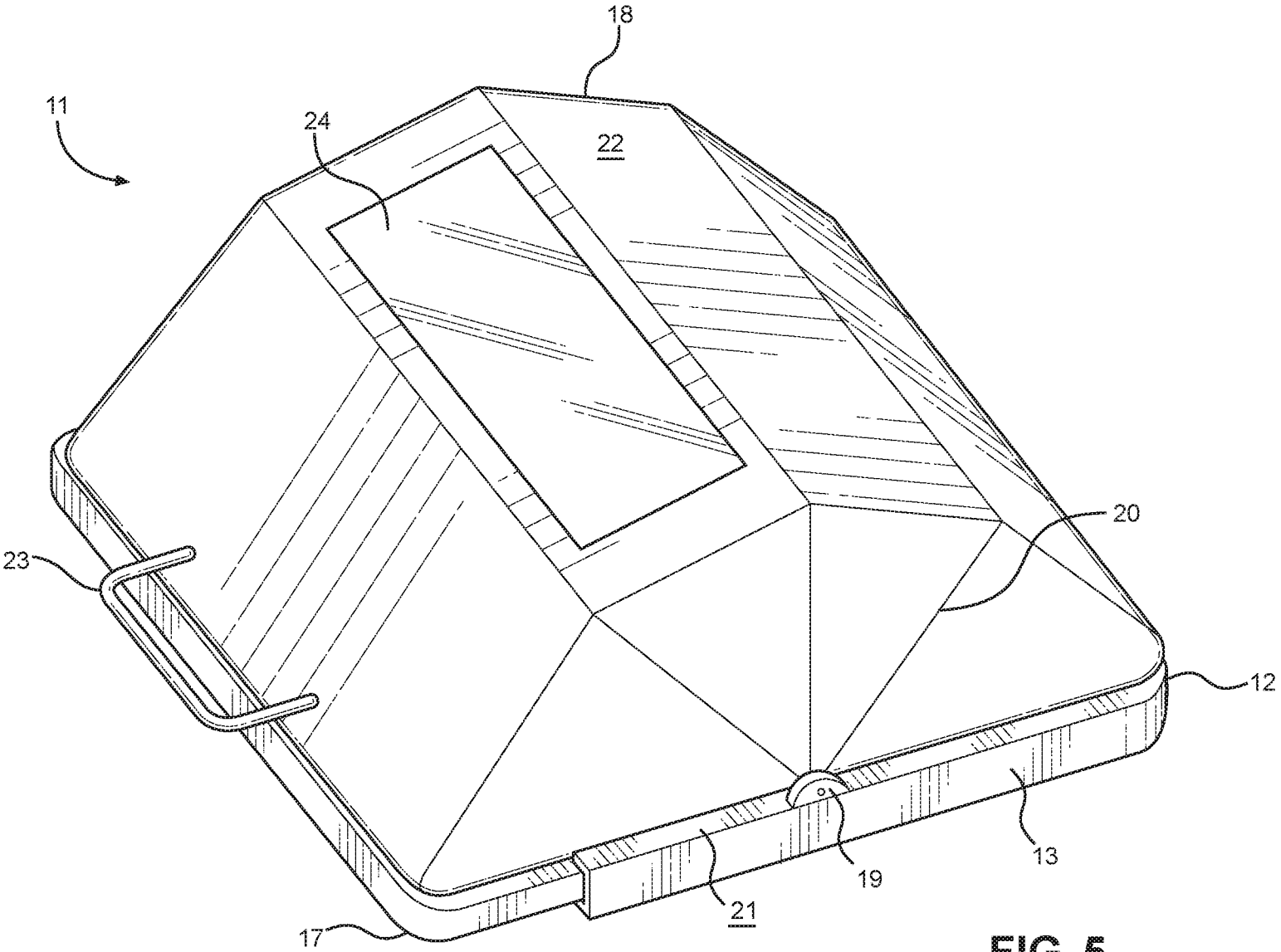
FIG. 5 shows a perspective view of an embodiment of the collapsible serving tray covering system in a closed position.

Referring now to FIG. 5, there is shown a perspective view of an embodiment of the collapsible serving tray covering system in a closed position. A covering system 18 is pivotally connected about a connector 19 disposed on a top surface 21 of each of the perpendicular protrusions 13, 14. A fabric material 22 is attached between each of the rib supports 20 at regular intervals. The covering system 18 can be used in either an open or a closed position as well as a partial opened position to access the contents thereof while still providing protection. An open position is defined when the plurality of rib supports 20 and attached fabric material 22 are folded flush against the elongated bracket 12 leaving an attached serving tray 17 installed within the collapsible serving tray covering system 11 exposed and free for a user to interact with. A closed position is defined when the covering system 18 is deployed such that the fabric material 22 forms a semi-cylindrical shape having an interior volume over a serving tray 17 installed within the collapsible serving tray covering system 11. When in a closed position, the rib supports 20 rotate around the pivotal connection 19 and stop at points along the 180-degrees such that the fabric material 22 covers the serving tray 17 contents. The rib supports 20 are sewn into the fabric material 22 in a fashion that has each rib support 20 stops roughly equidistant from one another. In the illustrated embodiment, the individual rib supports 20 correspond to angles of 0-degrees 45-degrees, 90-degrees, 135 degrees, and 180-degrees relative to the elongated bracket 12. A handle 23 is disposed on the outermost rib support 20 and attached fabric material 22 to allow for a user to engage with the covering system 18 and transfer the collapsible serving tray covering system 11 between an open and closed position more easily. In the illustrated embodiment, a portion of the fabric material 22 of the covering system 18 is composed of a transparent film material constituting a window 24.

Figure 6:
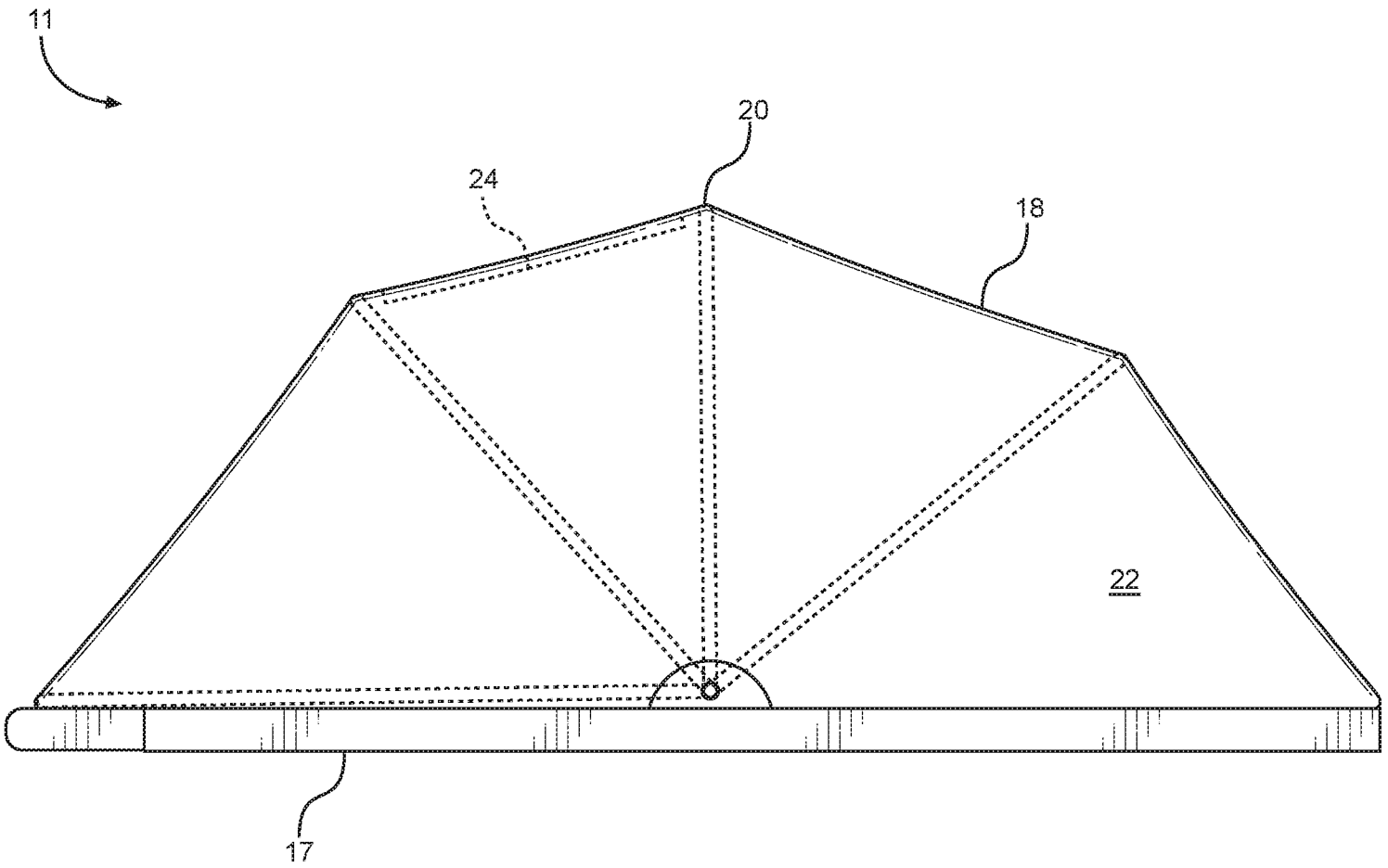
FIG. 6 shows a side view of an embodiment of the collapsible serving tray covering system in a closed position.

Referring now to FIG. 6, there is shown a side view of an embodiment of the collapsible serving tray covering system in a closed position. In the preferred embodiment, the fabric material 22 of the covering system 18 comprises a lightweight and waterproof canvas material. The window 24 disposed on the covering system 18 allows for a user to view the contents of a serving tray 17 installed in the collapsible serving tray covering system 11 when the covering system 18 is in a closed position. In the illustrated embodiment, the transparent film material of the window 24 in the covering system 18 is comprised of a durable and pliable plastic. In alternate embodiments, the window 24 may be constructed of any suitable transparent film material and may extend to include the entire fabric material 22 of the covering system 18. The plurality of rib supports 20 are sewn within the fabric material 22 of the covering system 18 at angles that allow the fabric material 22 to keep its shape and when in a closed position. When in a closed position, the fabric material 22 of the covering system 11 comprises a planar surface between each rib support 22 to keep the system taut and require minimal amount of fabric material 22. In the illustrated embodiment, the rib supports 20 are affixed within the fabric material 22 that correspond with angles of 0 degrees, 45 degrees, 90 degrees, 135 degrees, and 180 degrees when in a closed position.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A collapsible serving tray covering system, comprising:

an elongated bracket having two perpendicular protrusions which run parallel with each other creating a substantially rectangular three-sided enclosure;

a continuous channel extending along an entire interior of each of the elongated bracket and perpendicular protrusions wherein the channel is oriented towards a center of the enclosure;

wherein the channel is adapted to secure a serving tray there within;

a covering assembly disposed on an upper surface of the elongated bracket and the pair of protrusions;

wherein the covering assembly comprises a plurality of ribs pivotally connected to the upper surface of the perpendicular protrusions of the elongated bracket;

a fabric material is attached to each of the plurality of ribs at regular intervals such that a semi-cylindrical interior volume is defined when the covering assembly moves radially around the pivotal connections along the perpendicular protrusions.

2. The collapsible serving tray covering system of claim 1, wherein the fabric material of the covering assembly comprises a lightweight canvas.

3. The collapsible serving tray covering system of claim 1, wherein a handle is disposed on the covering assembly.

4. The collapsible serving tray covering system of claim 1, wherein the ribs of the covering assembly are made of a metallic construction.

5. The collapsible serving tray covering system of claim 1, wherein the ribs of the covering assembly are composed of a flat stock construction.

6. The collapsible serving tray covering system of claim 1, wherein the ribs of the covering assembly are sewn within the fabric material.

7. The collapsible serving tray covering system of claim 1, wherein the covering system is selectively configured to move between an open position and a closed position.

8. The collapsible serving tray covering system of claim 7, wherein an open position is defined when the plurality of supporting ribs rest parallel to, and on top of, the elongated bracket.

9. The collapsible serving tray covering system of claim 7, wherein a closed position is defined when one of the plurality of supporting ribs rests flush against the upper surface of each of the pair of protrusions on opposite sides of the pivotal connection.

10. The collapsible serving tray covering system of claim 1, wherein a window of transparent plastic film is incorporated within the covering assembly.

11. The collapsible serving tray covering system of claim 1, wherein the elongated bracket is linear.

12. The collapsible serving tray covering system of claim 9, wherein the closed position, the fabric material between adjacent ribs of the plurality of ribs comprises a planar surface.

13. The collapsible serving tray covering system of claim 9, wherein the plurality of rib supports are disposed at 45-degree angle intervals relative to a plane of the elongated bracket when in the closed position.

14. The collapsible serving tray covering system of claim 9, wherein the plurality of ribs are disposed equidistant from each other when in the closed position.

15. The collapsible serving tray covering system of claim 1, wherein a length of each of the plurality of ribs is greater than a linear distance between the pivotal connection and a distal end of one of the pair of perpendicular protrusions.

16. The collapsible serving tray covering system of claim 1, wherein the plurality of ribs pivot about an axis parallel to a longitudinal axis of the elongated bracket.

17. The collapsible serving tray covering system of claim 1, wherein the fabric material is affixed to an upper surface of the elongated bracket and each perpendicular protrusion between the elongated bracket and the pivotal connection.

* * * * *